United States Patent [19]

Okamura

[11] 4,263,845

[45] Apr. 28, 1981

[54] METHOD AND APPARATUS FOR PRINTING THE SURFACE OF A BAG WHICH HAS BEEN FILLED WITH A CONTENT

[75] Inventor: Shiro Okamura, Kyoto, Japan

[73] Assignee: Oji Seitai Kaisha, Ltd., Tokyo, Japan

[21] Appl. No.: 971,846

[22] Filed: Dec. 21, 1978

[30] Foreign Application Priority Data

Dec. 21, 1977 [JP] Japan ..... 52/152939

[51] Int. Cl.[3] ..... B41F 17/00

[52] U.S. Cl. ..... 101/35; 101/426; 53/131; 53/411

[58] Field of Search ..... 101/35, 36, 37, 426; 156/DIG. 18, DIG. 19; 53/131, 411

[56] References Cited

U.S. PATENT DOCUMENTS

| | | | |
|---|---|---|---|
| 2,491,947 | 12/1949 | Bardash | 101/35 |
| 2,645,870 | 7/1953 | Smith et al. | 101/35 X |
| 2,818,799 | 1/1958 | Hayward | 101/37 |
| 3,302,599 | 2/1967 | Valyi | 101/36 |
| 3,659,522 | 5/1972 | Dubuit | 101/35 |

FOREIGN PATENT DOCUMENTS

| | | | |
|---|---|---|---|
| 2037706 | 2/1972 | Fed. Rep. of Germany | 101/35 |
| 2375098 | 7/1978 | France | 53/131 |
| 748362 | 5/1956 | United Kingdom | 101/35 |

*Primary Examiner*—Clifford D. Crowder
*Attorney, Agent, or Firm*—Fleit & Jacobson

[57] ABSTRACT

The air in a bag which has been filled with a content is first removed by pressing to flatten the surface of the bag. The bag is then transported and supported in such a manner that it assumes an arc shape having a fixed curvature with which the convex surface of the bag is permitted to be opposed to the convex surface of a printing plate at a position just below said plate. Under these conditions, the surface of the bag is clearly printed. The apparatus for effecting the printing method of the present invention comprises a pressing device for pressing the bag, a printing plate mounted on a plate cylinder of a rotary letter press and detector for causing the plate cylinder to be rotatively driven and the rotation thereof to be stopped.

13 Claims, 3 Drawing Figures

METHOD AND APPARATUS FOR PRINTING THE SURFACE OF A BAG WHICH HAS BEEN FILLED WITH A CONTENT

BACKGROUND OF THE INVENTION

The present invention relates to a method for clearly and assuredly printing the surface of a bag which has been filled with a content composed of powder or granule with the grade or number of the content, and to the apparatus for effecting the same.

In most cases, it is required to print additionaly the surface of a bag which has been filled with a content composed of powder or granule with the grade, factory name, date and production number.

In cases where the surface of the bag which has been filled with such a content is printed, if the content filled in such a bag is a highly flowable material such as powder or granule, the content in the bag is caused to flow in the direction indicated by the arrow in FIG. 1 by the pressure exerted by a printing plate, with the result that the surface of the bag is deformed. As a consequence of such deformation, certain portions of the bag are not subjected to the pressure produced by said printing plate, resulting in unclear printing. Thus the prior art method has a great defect.

As a result of intensive investigations made for the purpose of obviating such a defect that the surface of a bag which has been filled with a content composed of powder or granule is not clearly printed according to the prior art method, it has been found that the surface of the bag can clearly be printed without causing the content to flow by the pressured produced by a printing plate by first removing the air in the bag by pressing to flatten the surface of the bag, supporting and transporting the flattened bag in such a manner that it assumes an arc shape having a fixed curvature with which the convex surface of the bag is permitted to be opposed to the convex surface of the printing plate and allowing the surface of the bag to be clearly printed by the printing plate in a state where the surface of the bag is tensed at a position just below the printing plate while pressing the content.

SUMMARY OF THE INVENTION

A main object of the present invention is to provide a method for printing the surface of a bag which has been filled with a content composed of powder or granule, characterized by removing the air in the bag by pressing to flatten the surface thereof, moving the thus flattened bag and supporting the bag in such a manner that the surface of the bag assumes an arc shape having a fixed curvature with which the convex surface of the bag is permitted to be opposed to the convex surface of the printing plate at a position just below said printing plate, whereby the surface of the bag is clearly printed.

Another object of the present invention is to provide the apparatus for effecting said printing method.

These objects which are believed to be novel are set forth with particularity in the appended claims. The present invention, both as to its organization and manner of operation, together with further objects and advantages thereof, may best be understood by reference to the following description, taken in connection with the accompanying drawings.

DETAILED DESCRIPTION OF THE INVENTION

Figure 1:
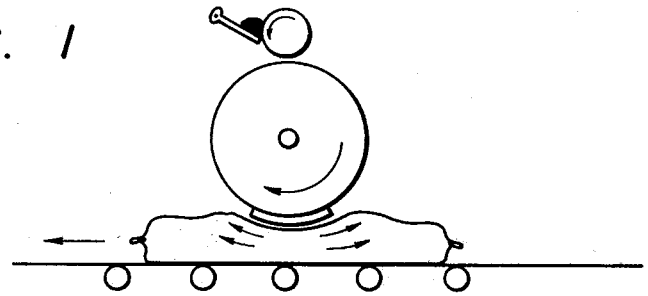
FIG. 1 is a view illustrative of the prior art method for printing the surface of a bag which has been filled with a content composed of powder or granule with the aid of a printing plate.
Figure 2:
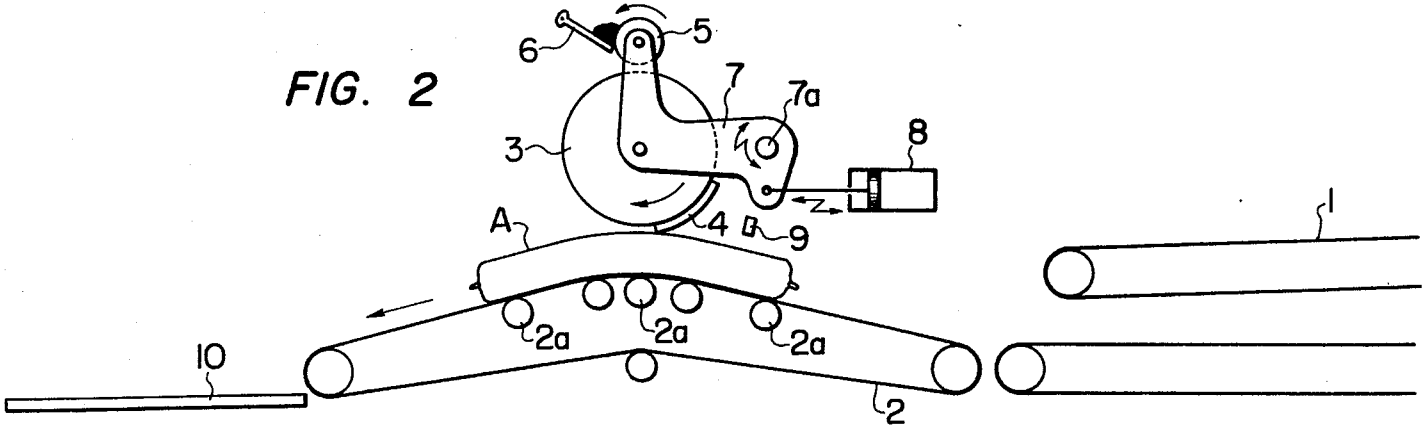
FIG. 2 is a front view showing main parts of the apparatus for effecting the method of printing the surface of a bag which has been filled with a content according to the present invention.
Figure 3:
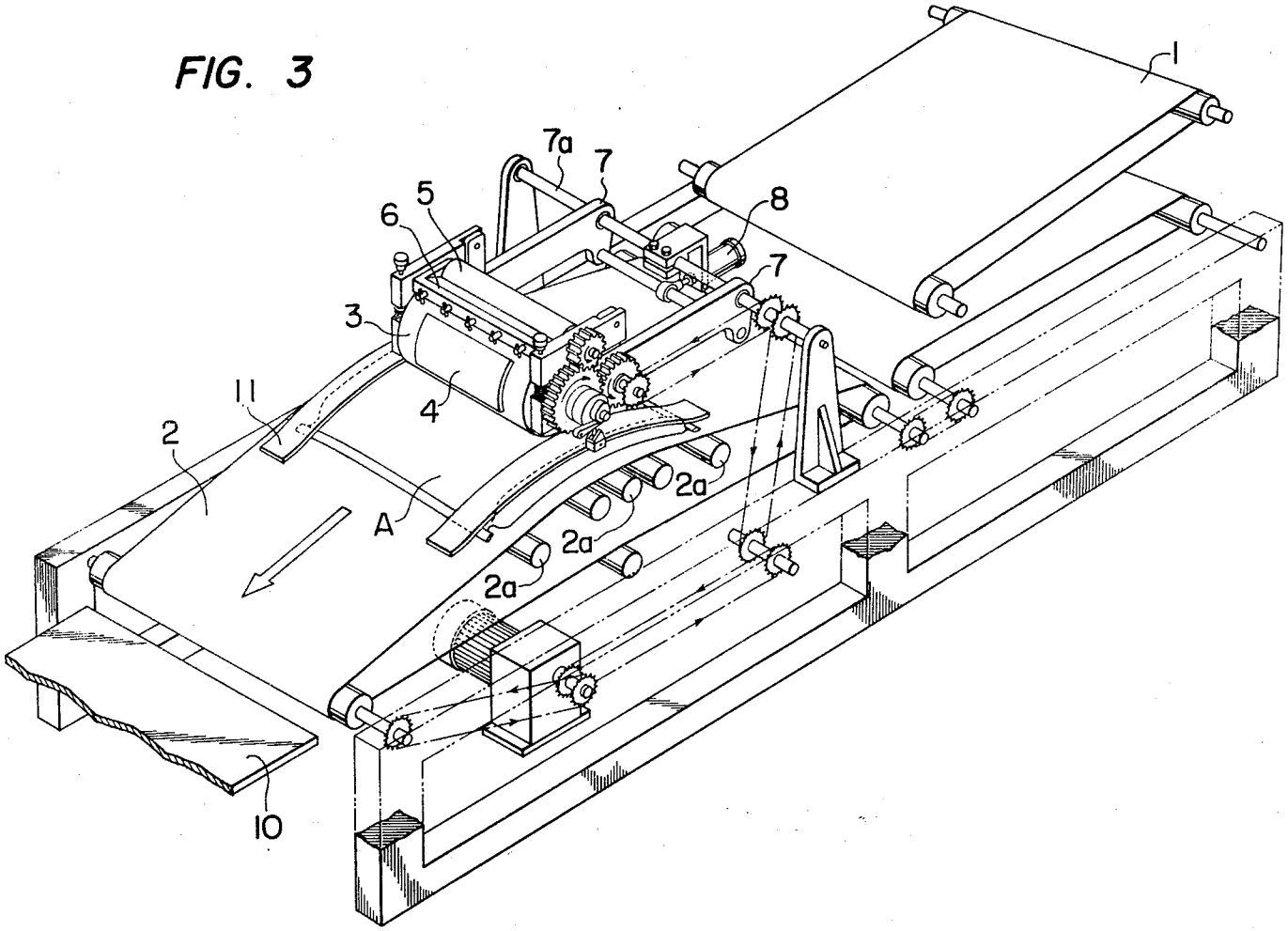
FIG. 3 is a perspective view showing the structure of the apparatus for printing the surface of a bag which has been filled with a content according to the present invention.

In the drawings, reference numeral 1 denotes a pressing device for pressing the air in a bag A which has been filled with a content consisting of powder or granule for its removal to flatten the surface of the bag. In the embodiment illustrated, use is made of a press conveyor which is adapted to press the bag A while it is moved; however, use of such a structure that is designed to press the bag A while it is moved is not always necessitated. In any event, it is essential that the bag A which has been filled with a content is shifted to just below a printing plate. For this reason, it is most preferable to employ a press conveyor in which a device for flattening the surface of the bag A and a device for moving the bag A are constructed as an integral unit. Reference numeral 2 represents a conveyor belt for transporting the bag A to just below the printing plate at a fixed speed, from which the air has been removed by pressing effected by the pressing device 1 and the surface of which has been flattened. This conveyor belt 2 is so designed that the bag A is supported such that the surface of the bag A to be printed assumes an arc shape having a constant curvature with which the convex surface of the bag is allowed to be opposed to the convex surface of the printing plate at a position just below the printing plate. For the purpose, it is required to provide just below and near the printing plate a plurality of guide rollers 2*a* or guide plates for supporting the conveyor belt 2 on the same arc. Reference numeral 3 stands for a plate cylinder of a rotary letter press which is rotatably mounted above the guide rollers 2*a* or guide plates for the conveyor belt 2 and which is rotatively driven by a driving means such as a train of gears and/or chains. This plate cylinder 3 starts to rotate at the time only when a detector 9 such as a beam switch senses the fact that the front end of the bag A has reached a given position on the conveyor belt 2, and stops after its number of revolutions has reached a predetermined value (usually exactly one). Reference numeral 4 denotes a printing plate for printing the necessary particulars such as the grade and number of the powder or granule being a content, the factory name or the date on the surface of the bag A, which is fixed at a given position on the plate cylinder 3. This rotary letter press has a printing plate 4 rotating at a speed equal to the rate of movement of the surface being printed of the bag A caused to move by the conveyor belt 2, and is set such that the shortest distance between the printing plate 4 and the surface of the conveyor belt 2 is slightly shorter than the thickness of the bag A the surface of which has been flattened at the time when the printing plate 4 is rotated and positioned just below the plate cylinder 3. Reference numeral 5 represents an inking roller for applying printing ink to the surface of the printing plate 4, which roller is always permitted to be in contact with a doctor blade 6 so as to prevent application of excess printing ink to the printing plate 4. Reference numeral 7 stands for a pair of swing plates for rotatably supporting the inking roller 5, which are caused to swing centering a fulcrum 7*a*. These swing plates 7 are driven and caused to swing centering the fulcrum 7*a* by an air cylinder 8 such that the printing plate 4 fixed on the plate cylinder 3 is pressed against the surface of the bag A, when the plate cylinder 3 is rotatively driven to shift the printing plate 4 to just above the bag A after the detector 9 has sensed the fact that the front end of the bag A has reached a given position on the conveyor belt 2. The printing portion can be predetermined by means of a presettable timer which postpones the starting of rotation of the plate cylinder 3 and of swinging of the swing plates 7 for a preset period (for instance, several seconds). Reference numeral 10 denotes a table for receiving the bag A sent out by the conveyor belt 2 after the completion of printing Reference numeral 11 stands for guide plates for holding the upper portions of both ends of the bag A conveyed by the conveyor belt 2 so as to permit the bag A to attain a constant curvature at a position just below the printing plate 4. These guide plates may or may not be provided dependent upon the size and stiffness of the bag A and the properties of a content filled therein.

The apparatus for effecting the method for printing given particulars on the surface of a bag which has been filled with a content in accordance with the present invention comprises a pressing device 1 for pressing the air in a bag A which has been filled with a content composed of powder or granule for its removal so as to flatten the surface thereof, a conveyor belt 2 designed so that the bag A from which the air has been removed by pressing effected by the pressing device 1 and the surface of which has been flattened is supported and transported in such a manner that it is shifted to just below a printing plate 4 mounted on a given position on a plate cylinder 3 of a rotary letter press at a speed equal to the peripheral speed of the printing rotary plate 4 and the surface of the bag A assumes an arc shape having a fixed curvature with which the convex surface of the bag A is permitted to be opposed to the convex surface of said printing plate at a position just below said printing plate, a detector 9 for sensing the front end of the bag A reaching a given position on the conveyor belt 2 to rotatively drive the plate cylinder 3 so as to allow the predetermined portion of the bag A to be printed by the printing plate 4. In printing the surface of the bag A at a position just below the printing plate 4, the air therein has already been removed by pressing effected by the pressing device 1, and the bag A is supported such that its surface assumes an arc shape having a fixed curvature with which the surface of the bag is permitted to be opposed to the convex surface of the printing plate. Consequently, the content filled in the bag A is subjected to the tension applied to the surface thereof. This ensures that the bag is uniformly tensed, and that the bag is no longer deformed under the pressure resulting from the printing plate 4. Thus, in spite of its extremely simple structure, the apparatus according to the present invention permits satisfactory printing. Furthermore, the detector 9 renders it possible to make clear printing on a predetermined portion on the surface of the bag A, even when a number of bags A are discontinuously and intermittently supplied. In accordance with this printing method for printing the surface of the bag A, the curvature of an arc shape which the bag assumes at a position just below the printing plate 4 varies slightly dependent upon the size and material of the bag as well as the kind of the content, and may be in the order of 1/500 $mm^{-1}$ according to experiments for sufficient results.

As described in detail, the method and apparatus for printing the surface of a bag which has been filled with a content according to the present invention are epock-making in the point that they permit clear and sure printing of the surface of a bag which has been filled with a content composed of flowable powder or granule, which has been heretofore considered impossible. In particular, the apparatus of the present invention can always allow accurate and clear printing of a predetermined portion of such a bag even in case of the discontinuous and intermittent supply of bags, and is of great industrial value.

The invention has been described in detail sufficient to enable one of ordinary skill in the art to make and use the same. Obviously, modifications and alterations of the preferred embodiment will occur to others upon a reading and understanding of the specification and it is the invention to include all such modifications and alterations as part of the invention insofar as they come within the scope of the appended claims.

What is claimed is:

1. A method for printing the surface of a bag which has been filled with a content composed of powder or granule, which comprises removing the air in the bag by pressing to flatten the surface thereof, moving the thus flattened bag and supporting the bag in such a manner that the surface of the bag assumes an arc shape having a fixed curvature with which the convex surface of the bag is permitted to be opposed to the convex surface of a printing plate at a position just below said printing plate, whereby the surface of the bag is clearly printed.

2. A method as claimed in claim 1, in which a press conveyor is used as means for removing the air in the bag by pressing to flatten the surface thereof.

3. A method as claimed in claim 1 or 2, in which the surface of the bag has a fixed curvature of about 1/500 $mm^{-1}$ at a position just below the printing plate.

4. A method as claimed in claim 3, in which the conveyor belt supported by guide rollers disposed on the same arc is used as means for supporting the bag in such a manner that the surface thereof assumes an arc shape having a fixed curvature at a position just below the printing plate.

5. A method as claimed in claim 1 or 2, in which the conveyor belt supported by guide rollers disposed on the same arc is used as means for supporting the bag in such a manner that the surface thereof assumes an arc shape having a fixed curvature at a position just below the printing plate.

6. An apparatus for printing the surface of a bag which has been filled with a content composed of powder or granule, comprising:

a pressing device 1 for pressing the air in a bag A which has been filled with said content, for removal of the air so as to flatten the surface of the bag;

a conveyor belt 2 designed such that the bag A, pressed by the pressing device 1, is supported and transported in such a manner that it is shifted to just below a printing plate 4 mounted on the curved face of a plate cylinder 3 of a rotary letter press, at a speed equal to the peripheral speed of the printing plate 4, and the surface of the bag A assumes an arc shape having a fixed curvature such that the convex surface of the bag is permitted to be opposed to the convex surface of the printing plate 4, at a position just below the printing plate 4;

a detector 9 for sensing the front end of the bag A reaching a given position on the conveyor belt 2, to rotatively drive the plate cylinder 3, which stops after its number of revolutions has reached a predetermined value.

7. An apparatus as claimed in claim 6, in which the pressing device 1 is a press conveyor.

8. An apparatus as claimed in claim 6 or 7, in which the means for supporting the conveyor belt 2 at a fixed curvature directly below the printing plate 4 are a plurality of guide rollers 2*a*.

9. An apparatus as claimed in claim 8, in which the conveyor belt 2 is provided with guide plates 11 for holding the upper portions of both ends of the bag A transported by the conveyor belt 2.

10. An apparatus as claimed in claim 8, in which the plate cylinder 3 stops after its number of revolutions has reached exactly one.

11. An apparatus as claimed in claims 6 or 7, in which the conveyor belt 2 is provided with guide plates 11 for holding the upper portions of both ends of the bag A transported by the conveyor belt 2.

12. An apparatus as claimed in claim 11, in which the plate cylinder 3 stops after its number of revolutions has reached exactly one.

13. An apparatus as claimed in claims 6 or 7, in which the plate cylinder 3 stops after its number of revolutions has reached exactly one.

* * * * *